US009016198B2

(12) United States Patent
Lam et al.

(10) Patent No.: US 9,016,198 B2
(45) Date of Patent: Apr. 28, 2015

(54) PRINTERS, METHODS, AND APPARATUS TO FILTER IMAGING OIL

(75) Inventors: Quang P Lam, Hayward, CA (US); Michael H Lee, San Jose, CA (US); Omer Gila, Cupertino, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1241 days.

(21) Appl. No.: 12/898,316

(22) Filed: Oct. 5, 2010

(65) Prior Publication Data

US 2012/0079955 A1 Apr. 5, 2012

(51) Int. Cl.

| | |
|---|---|
| ***B41F 1/00*** | (2006.01) |
| ***G03G 21/00*** | (2006.01) |
| ***G03G 15/10*** | (2006.01) |

(52) U.S. Cl.

CPC ..... *G03G 15/104* (2013.01); *G03G 21/0088* (2013.01)

(58) Field of Classification Search

USPC ..... 204/450, 550, 600, 660; 210/748.01; 422/20; 101/287, 368, 486

See application file for complete search history.

(56) References Cited

U.S. PATENT DOCUMENTS

| | | | | |
|---|---|---|---|---|
| 5,028,959 | A * | 7/1991 | Gooray | 399/93 |
| 5,656,146 | A * | 8/1997 | Day et al. | 204/648 |
| 7,590,368 | B2 | 9/2009 | Kamijo et al. | |
| 8,398,840 | B2 * | 3/2013 | Daily, III | 204/554 |
| 2008/0226335 | A1 | 9/2008 | Van Sas et al. | |
| 2009/0175665 | A1 | 7/2009 | Wilde et al. | |
| 2010/0098454 | A1 | 4/2010 | Kastner | |

FOREIGN PATENT DOCUMENTS

| | | |
|---|---|---|
| JP | 2002268385 | 9/2002 |
| JP | 2002365941 | 12/2002 |
| JP | 2002365991 | 12/2002 |

* cited by examiner

*Primary Examiner* — Walter D Griffin
*Assistant Examiner* — Cameron J Allen
(74) *Attorney, Agent, or Firm* — Hanley Flight & Zimmerman, LLC

(57) ABSTRACT

Printers, methods, and apparatus to filter imaging oil are disclosed. An example apparatus to filter imaging oil, includes adjacent electrodes and a switching circuit. The example switching circuit selectively generates an electrostatic field between the adjacent electrodes to cause particles suspended in the imaging oil between the adjacent electrodes to adhere to at least one of the adjacent electrodes, and generates an alternating electric field between the adjacent electrodes to cause the particles to be detached from the adjacent electrodes.

20 Claims, 8 Drawing Sheets

PRINTERS, METHODS, AND APPARATUS TO FILTER IMAGING OIL

BACKGROUND

In some printers, a photo imaging plate is used to transfer ink to a print substrate to form an image. Ink is applied directly to the photo imaging plate, which then applies the ink to the print substrate. This method of printing is very flexible and can create many copies of one or more images.

DETAILED DESCRIPTION

The lifetime of a photo imaging plate used in a printer depends on different aspects of the printer's liquid electrophotographic (LEP) process, including dot shrinkage. The transfer of small dots from the photo imaging plate to the substrate is reduced, which decreases the area of the small dots on a print and, thus, causes the image to be lighter than it would be in the absence of dot shrinkage. Additionally, this loss of small dot transfer may be non-uniform, which may result in observed streaks or lines down a printed image and reduced subjective print quality. When such a reduction in print quality occurs, the photo imaging plate may be replaced to regain satisfactory print quality.

To slow the onset of dot shrinkage, a printer may include a cleaning station to remove buildup of contaminants from the photo imaging plate. The cleaning station may use a cleaning fluid, such as imaging oil, to clean the photo imaging plate. However, as contaminants accumulate in the imaging oil, the effectiveness of the cleaning station decreases. Example printers, methods, and/or apparatus described herein may be advantageously used to increase the effectiveness of the cleaning station by reducing the amount and/or size of contaminants in the imaging oil (or other cleaning fluid).

Figure 1:
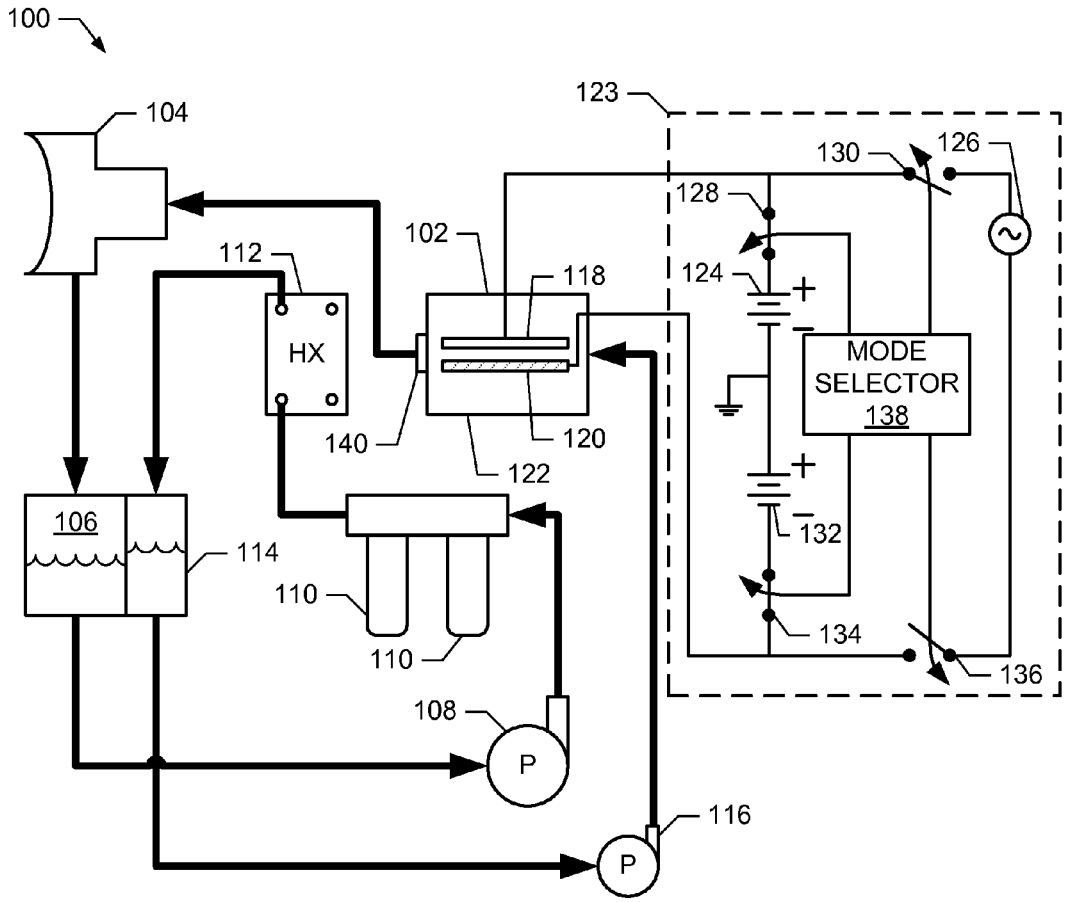
FIG. 1 is a schematic diagram of an example imaging oil recycling system including an electrophoretic imaging oil filter constructed in accordance with the teachings herein.

FIG. 1 is a schematic diagram of an example imaging oil recycling system 100, which includes an electrophoretic imaging oil filter 102. The electrophoretic imaging oil filter 102 may be used to filter imaging oil that is used by the imaging oil filtration system 100 to clean a photo imaging plate (not shown) via a cleaning station 104 in, for example, a liquid electrophotographic (LEP) printer. The cleaning station 104 removes undesired material (contaminants) such as ink particles from the photo imaging plate.

The recycling system 100 recycles used and/or polluted imaging oil (e.g., cleaning liquid) received from a cleaning station 104. The imaging oil carries the contaminants from the cleaning station to a holding tank 106 or reservoir.

A first pump 108 then recirculates the imaging oil from the holding tank 106 by pumping the imaging oil through one or more filters 110 and a heat exchanger 112. The filters 110 remove relatively large contaminant particles from the imaging oil. In some examples, the filters 110 are canister filters that are replaced when the pressure on the filters 110 and/or on the heat exchanger 112 exceeds a threshold (e.g., due to full and/or clogged filters 110). As the cleaning station 104 cleans the photo imaging plate, the cleaning station increases a temperature of the contaminated imaging oil from the temperature of the imaging oil originally supplied to the cleaning station 104. The heat exchanger 112 cools the imaging oil to a desired operating temperature (e.g., 14° Celsius). After the filters 110 and the heat exchange 112 filter and cool the imaging oil, respectively, the imaging oil is returned to a second holding tank 114.

A second pump 116 recirculates the partially-purified (e.g., canister-filtered) imaging oil in the second holding tank 114 to the cleaning station 104 via the electrophoretic imaging oil filter 102. In the example of FIG. 1, the electrophoretic imaging oil filter 102 is disposed just prior to the cleaning station 104 (e.g., filter 102 outputs imaging oil to the cleaning station 104 via a fluid path such as a hose) to further filter the imaging oil and to provide the clean imaging oil to the cleaning station 104. While other placements of the electrophoretic imaging oil filter 102 may be used, the example placement of the electrophoretic imaging oil filter 102 shown in FIG. 1 improves the performance of the cleaning station 104, improves print quality, and extends the effective operating life of the photo imaging plate relative to other example placements of the electrophoretic imaging oil filter 102 by reducing the progression of the dot shrinkage problem discussed above. Additionally, the placement of the electrophoretic imaging oil filter 102 after the filters 110 may increase the operating life and/or the performance of the electrophoretic imaging oil filter 102 by reducing the particle sizes reaching the filter 102.

The example electrophoretic imaging oil filter 102 of FIG. 1 includes electrodes (e.g., conductive plates) 118 and 120 disposed adjacent one another within a housing 122. The oil filter 102 is provided with or coupled to a switching circuit 123. The switching circuit 123 selectively couples the first electrode 118 to one of a first electrostatic potential (e.g., a first terminal of a direct current (DC) source 124 having a first electrical polarity) or to an alternating current (AC) source 126. A first switch 128 electrically couples the first electrode 118 to the DC source 124 and a second switch 130 electrically couples the first electrode 118 to the alternating current source 126. Conversely, the switching circuit 123 selectively couples the second electrode 120 to one of a second electrostatic potential (e.g., a second terminal of the DC source 124, a second terminal of a second DC source 132, to a reference potential such as a ground terminal, etc.) via a third switch 134 or to the alternating current source 126 via a fourth switch 136.

The example electrophoretic imaging oil filter 102 may operate in a filtering mode (e.g., when the cleaning station 104 is actively cleaning the photo imaging plate) and/or in a refresh mode (e.g., when the cleaning station 104 is inactive). A mode selector 138 determines whether the cleaning station 104 is active (e.g., when the cleaning station 104 is cleaning the photo imaging plate) and enables the electrophoretic imaging oil filter 102 in the appropriate mode based on the determination. For example, if the mode selector 138 determines that the cleaning station 104 is active, the mode selector 138 closes the switches 128 and 134 and opens the switches 130 and 132 to apply a first set of electrostatic potentials to the electrodes 118 and 120. As a result, the electrodes 118 and 120 generate a first electric field therebetween. As the example electrophoretic imaging oil filter 102 receives the imaging oil from the second holding tank 114 via the second pump 116, at least a portion of the imaging oil travels through the electric field, which causes at least some of the contaminants to adhere to at least one of the electrodes 118 or 120 due to electrophoretic force. The contaminants that adhere to one of the electrodes 118 or 120 do not accompany the imaging oil to the cleaning station 104. Thus, the electrophoretic imaging oil filter 102 provides highly purified imaging oil to the cleaning station 104, which improves the performance of the cleaning station 104 and extends the effective operating life of the photo imaging plate by slowing the onset and/or progression of dot shrinkage.

The direction of the electrophoretic force on the contaminants in the imaging oil may be dependent on the direction of the electric field and/or on the type of the contaminant. For example, assuming a uniform type of contaminant, the contaminant particles will be forced toward one of the first electrode 118 or the second electrode 120 depending on the physical characteristics of the particles and the polarity of the field. However, if a mixture of different types of contaminants is present, different contaminant types may be forced toward different ones of the electrodes 118 and 120.

As the contaminants collect on the electrode(s) 118 and 120, the strength of the electrostatic field and, thus, the effectiveness of the electrophoretic imaging oil filter 102 are reduced. Therefore, the example electrophoretic imaging oil filter 102 of FIG. 1 is adapted to periodically or aperiodically clean the electrodes 118 and 120. In the illustrated example, the filter 102 cleans the electrode(s) 118 and 120 by entering the refresh mode. Via refresh mode, the filter 102 at least partially cleans the electrodes 118 and 120 to regain at least some of the filtering effectiveness that has been lost due to the collected contaminants.

When the mode selector 138 of the illustrated example determines that the cleaning station 104 is inactive (e.g., the printer is not active, so the cleaning station 104 does not need to clean the photo imaging plate), the mode selector 138 places the electrodes 118 and 120 in the refresh mode by opening the switches 128 and 134 and closing the switches 130 and 132. In the refresh mode, the AC source 126 applies an alternating current to the example electrodes 118 and 120 to create an alternating electric field between the electrodes 118 and 120. Because the electrostatic field is now removed, the contaminants are not longer forced to a respective one of the electrodes 118 and 120. Instead, the alternating electric field has a half-cycle in which contaminants previously drawn to a respective electrode are repelled from that electrode because of the reversed electric polarity relative to the electrostatic field applied in the filtering mode. As a result, the alternating electric field loosens contaminants from the electrodes 118 and 120. After the contaminants detach from the electrodes 118 and 120, the freed contaminants are suspended in the imaging oil located between the electrodes 118 and 120. In some examples, the imaging oil including the suspended contaminants may be circulated through the imaging oil recycling system 100 and/or replaced to remove the imaging oil including the contaminants.

The example imaging oil recycling system 100 of FIG. 1 further includes a sensor 140 to determine a concentration and/or makeup of the contaminants in the imaging oil. If the sensor 140 determines that the concentration of the contaminants in the imaging oil is too high, the sensor 140 signals that the imaging oil should be replaced and/or cleaned to reduce the concentration of contaminants. The sensor 140 may be implemented by one or more sensors, may make the determination at any time, and/or may be placed at other locations in the system 100. The sensor 140 may have different threshold levels depending on where the sensor 140 is located in the imaging oil recycling system 100 and/or whether the electrophoretic imaging oil filter 102 is actively filtering. For example, the sensor 140 may be located at an output port of the electrophoretic imaging oil filter 102 to determine an amount of contaminants in the imaging oil during the refresh mode and/or to determine an effectiveness of the filter. In some other examples, the sensor 140 may be located prior to an input port of the filter 102 to determine an amount of contaminant in the imaging oil recycling system 100. Sensors 140 located in different locations of the system 100 enable comparison of contaminant levels at different locations and, thus, determinations of the effectiveness of different parts (e.g., filters 102, 110) of the system 100.

The example mode selector 138 may be implemented using machine readable instructions stored on computer-readable media such as, for example, a hard disk drive, a flash memory, a read-only memory (ROM), a compact disk (CD), a digital versatile disk (DVD), a cache, a random-access memory (RAM) and/or any other storage media in which information is stored for any duration (e.g., for extended time periods, permanently, brief instances, for temporarily buffering, and/or for caching of the information), and/or an internal memory of a printer in which the imaging oil recycling system 100 is implemented. The stored instructions may then be executed by, for example, one or more circuit(s), programmable processor(s), application specific integrated circuit(s) (ASIC(s)), programmable logic device(s) (PLD(s)) and/or field programmable logic device(s) (FPLD(s)), etc. In some examples, the instructions are executed by a processing device implemented within a printer in which the imaging oil recycling system 100 is implemented. An example process 700 to implement the mode selector 138 is described in more detail below in conjunction with FIG. 7.

Figure 1A:
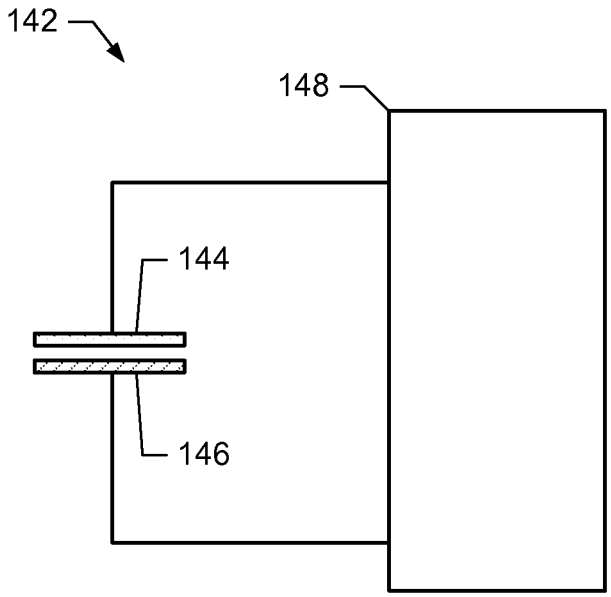
FIG. 1A is a schematic diagram of another example imaging oil recycling system including adjacent electrodes and a switching circuit constructed in accordance with the teachings herein.

FIG. 1A is a schematic diagram of another example imaging oil recycling system 142 including adjacent electrodes 144 and 146 and a switching circuit 148. The example switching circuit 148 selectively generates an electrostatic field between the adjacent electrodes 144 and 146 to cause particles suspended in imaging oil located between the adjacent electrodes to adhere to at least one of the adjacent electrodes 144 and 146. The example switching circuit 148 further generates an alternating electric field between the adjacent electrodes 144 and 146 to cause the particles to be detached from the electrodes 144 and 146.

Figure 2:
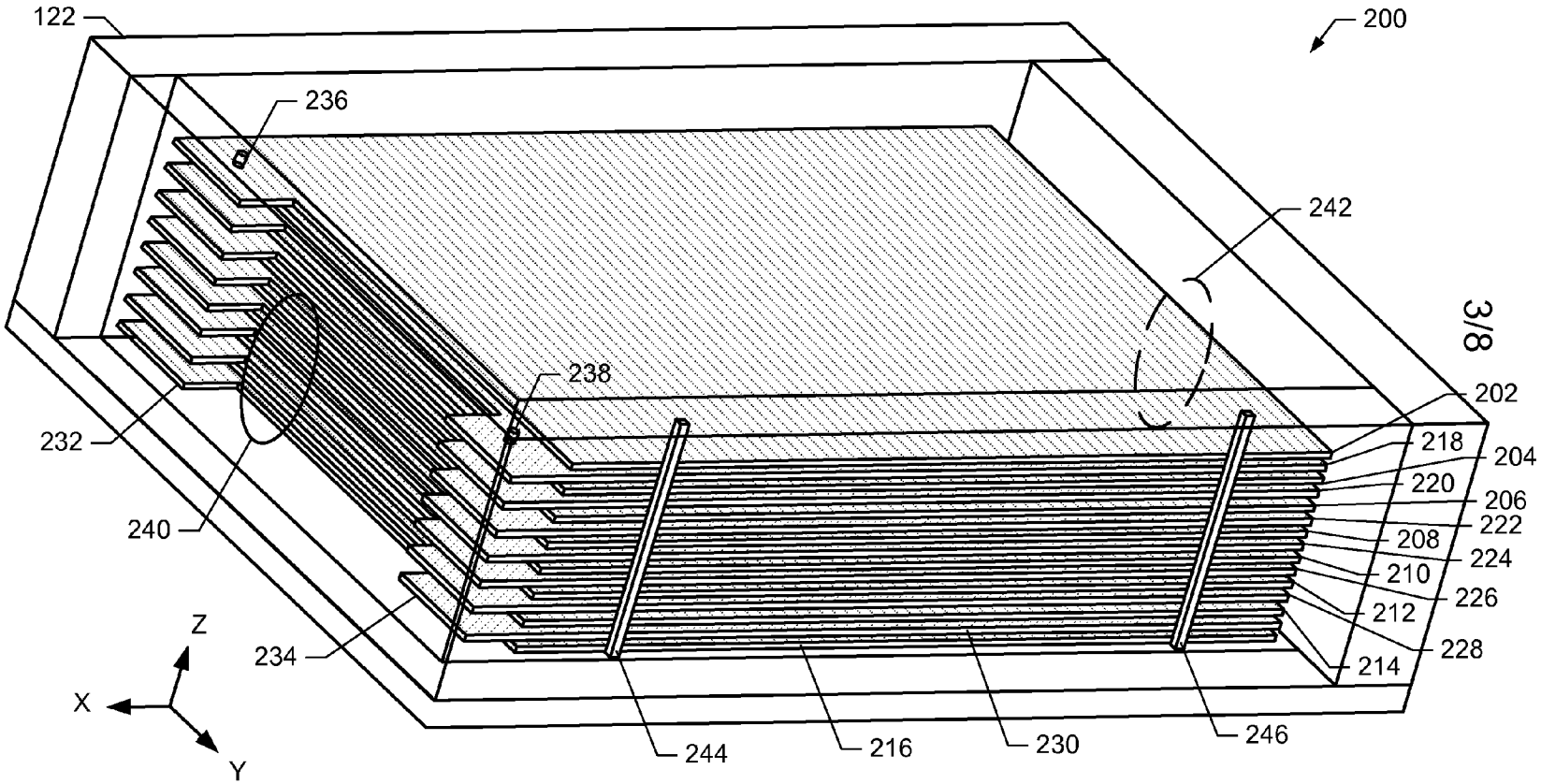
FIG. 2 is a perspective view of an example electrophoretic imaging oil filter which may be used in the system of FIG. 1.
Figure 3:
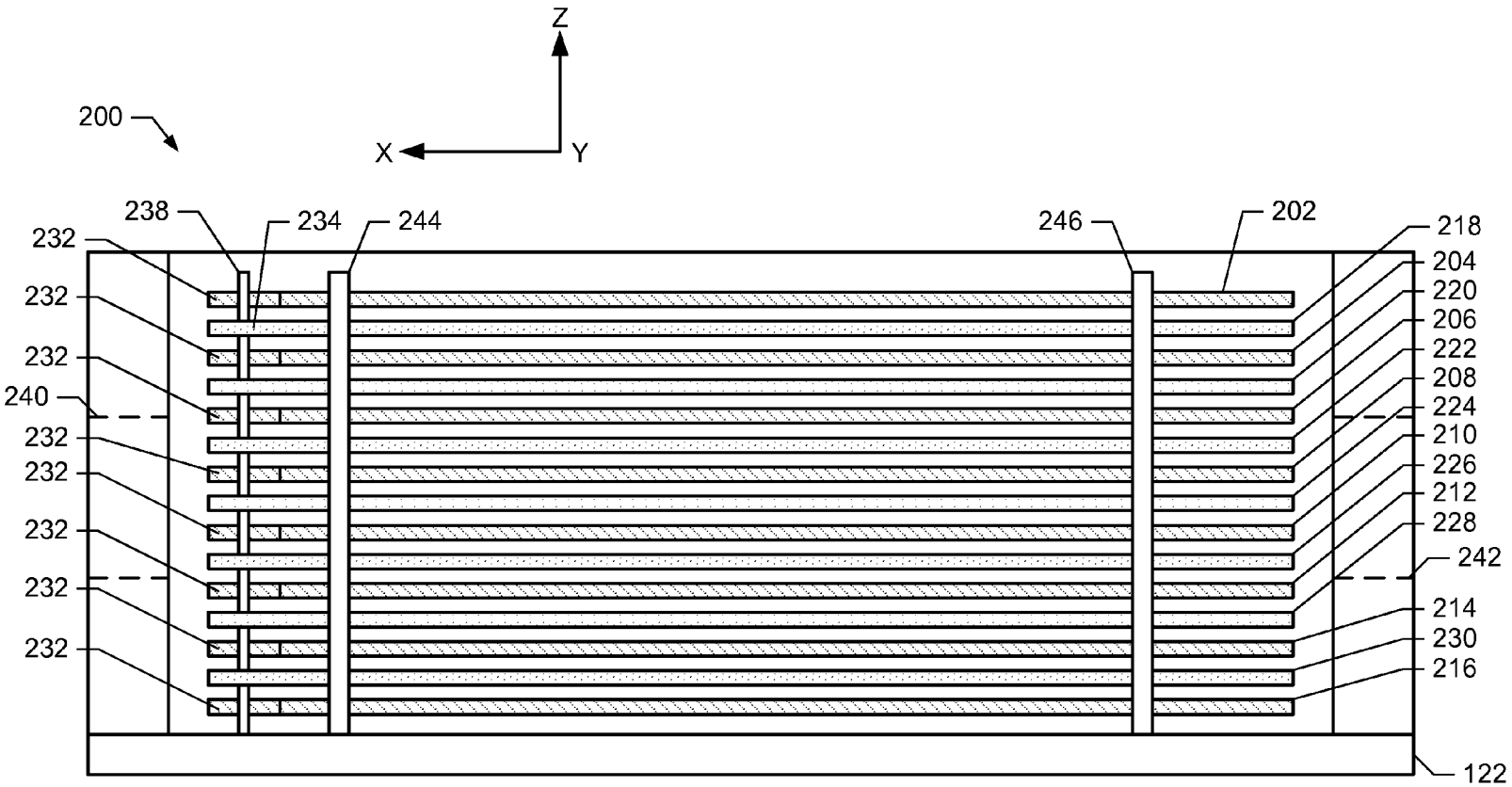
FIG. 3 is a profile view of the example electrophoretic imaging oil filter of FIG. 2.
Figure 4:
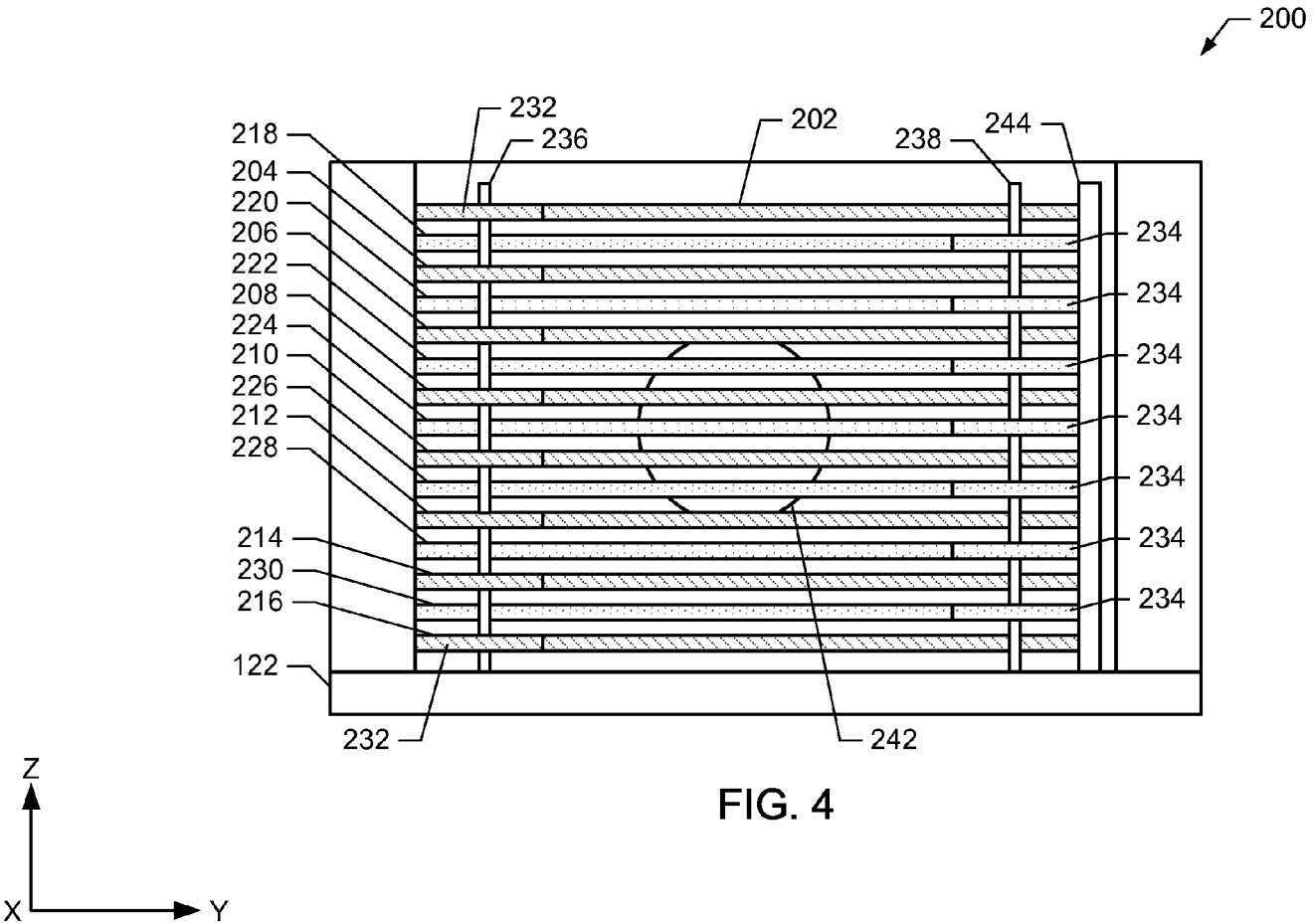
FIG. 4 is another profile view of the example electrophoretic imaging oil filter of FIG. 2.

FIG. 2 is a perspective view of an example electrophoretic imaging oil filter 200 to implement the electrophoretic imaging oil filter 102 of FIG. 1. FIG. 3 is a profile view of the example electrophoretic imaging oil filter 200 of FIG. 2, and FIG. 4 is another profile view of the example electrophoretic imaging oil filter 200. In the views illustrated in FIGS. 2-4 and described below, portions of the drawings are shown as transparent to avoid obscuring certain features in the respective views. Additionally, directional indicators are provided to demonstrate the relationships between the views of FIGS. 2-4.

As illustrated in FIG. 2, the example filter 200 includes the housing 122 of FIG. 1 and multiple electrodes 202-230. The electrodes 202-230 are arranged parallel to each other. A first set of example electrodes 202-216 (which correspond to the first electrode 118 of FIG. 1) are interleaved with a second set of example electrodes 218-230 (which correspond to the second electrode 120 of FIG. 1). In other words, the example first electrodes 202-216 are adjacent one or two of the second electrodes 218-230, with space between each adjacent pair of electrodes 202-230. For example, the first electrode 204 is adjacent two of the second electrodes 218 and 220. Similarly, the second electrode 226 is adjacent two of the first electrodes 208 and 210. As a result, the example filter 200 of FIG. 2 employs multiple instances of the first and second electrodes 118, 120 of FIG. 1. While the example electrodes 202-230 of FIG. 2 are implemented using conductive plates, the electrodes 202-230 may be implemented using other arrangements and/or shapes.

The first electrodes 202-216, which implement multiple instances of the first electrode 118 of FIG. 1, are in circuit with the switches 128 and 130 of FIG. 1 and, thus, may be selectively coupled to a first terminal of the DC source 124 or a first terminal of the AC source 126. Conversely, the second electrodes 218-230, which implement multiple instances of the second electrode 120 of FIG. 1, are in circuit with the switches 134 and 136 of FIG. 1 and, thus, may be selectively coupled to a second terminal of the DC source 132 or to a second terminal of the AC source 126. The example electrophoretic imaging oil filter 200 of FIG. 2 implements several sets of adjacent electrodes 118 and 120 to increase the filtering capacity of the filter 200. Each adjacent pair of electrodes 202-230 (e.g., electrodes 220 and 206, electrodes 206 and 222, electrodes 222 and 208, etc.) acts as a filter (or sub-filter) within the filter 200. While the example filter 200 includes eight first electrodes 202-216 and seven second electrodes 218-230, the filter 200 may include more or fewer electrodes 202-230 to increase or decrease filtering capacity and/or a flow rate of the imaging oil through the system 100. The precise number of electrodes (e.g., sub-filters) used in the filter 200 is a design choice to be made based on the application.

In the example of FIG. 2, each of the example first electrodes 202-216 has a tab 232. The tabs 232 are juxtaposed, one above the other in stacked, separated relation as shown in FIG. 2. In the example of FIG. 2, each of the example second electrodes 218-230 has a tab 234. The tabs 234 are juxtaposed, one above the other in stacked, separated relation as shown in FIG. 2. The tabs facilitate electrical connections to the circuits of FIG. 1. For example, the tabs 232 are each connected to a conductor 236, which couples the first electrodes 202-216 to the same electrical source or potential (e.g., the DC source 124, the AC source 126) simultaneously. Similarly, the tabs 234 are each connected to a conductor 238, which couples the second electrodes 218-230 to another electrical source or potential (e.g., the DC source 132, the AC source 126) simultaneously.

In the illustrated example, the example housing 122 is hermetically sealed. However, the housing 122 includes an inlet port 240 and an outlet port 242 (both shown schematically in FIG. 2). The example inlet port 240 may be in fluid communication with a pump (e.g., the pump 116 of FIG. 1). The example outlet port 242 may be in direct fluid communication with the cleaning station 104 of FIG. 1 to provide the cleaning station 104 with clean imaging oil for cleaning the photo imaging plate.

When the example filter 200 is enabled in filter mode (e.g., by the mode selector 138 of FIG. 1), the conductor 236 is coupled to a first electrostatic potential and charges the first electrodes 202-216 with the first potential. The conductor 238 is coupled to a second electric potential and charges the second electrodes 218-230 with a second potential. As a result, a plurality of electrostatic fields is generated (e.g., a field between each adjacent pair of first and second electrodes). The electrophoretic imaging oil filter 200 receives imaging oil, which may include contaminants, from the second holding tank 114 via the inlet port 240. As least some of, and likely most of, the imaging oil passes between at least one of the first electrodes 202-216 and an adjacent one of the second electrodes 218-230 thereby encountering one of the electrostatic fields such that contaminants suspended in the imaging oil are forced toward the first electrodes 202-216 and/or the second electrodes 218-230 depending on the electrical characteristics of the contaminants and the polarity of the electrostatic field.

To hold the electrodes 202-230 in their designated positions, the electrodes 202-230 may be attached to the housing 122 and/or may be supported by posts 244 and 246 that are attached to the housing 122. In some examples, the electrodes 202-230 are removable to enable the electrodes 202-230 to be replaced and/or cleaned further through a supplemental process (e.g., manual scrubbing).

Figure 5A:
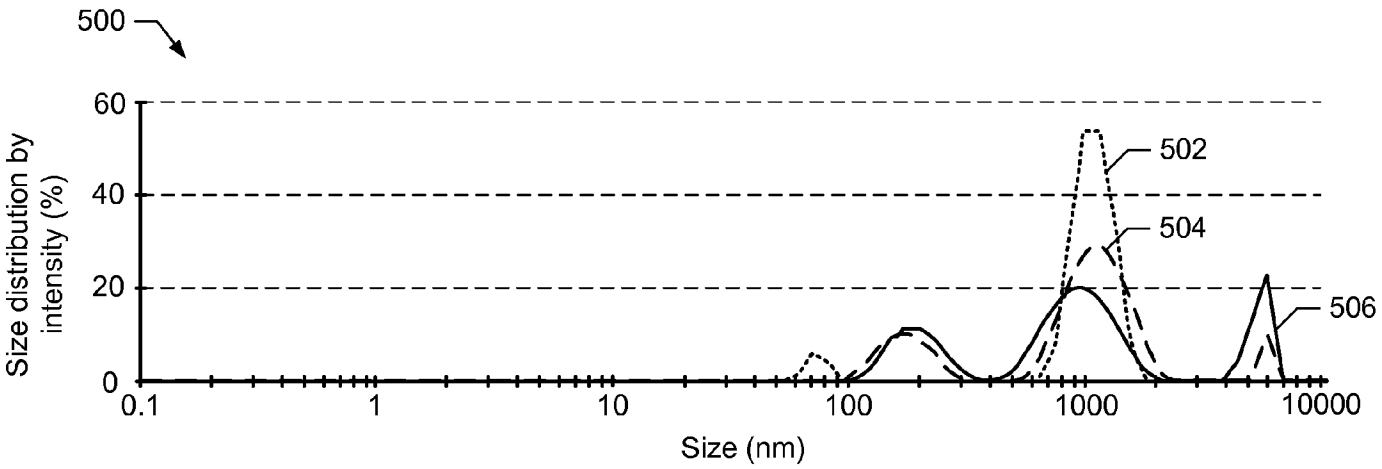
FIG. 5A is a graph illustrating example particle size distribution test results for contaminants in imaging oil prior to entering the example electrophoretic imaging oil filter of FIG. 2.
Figure 5B:
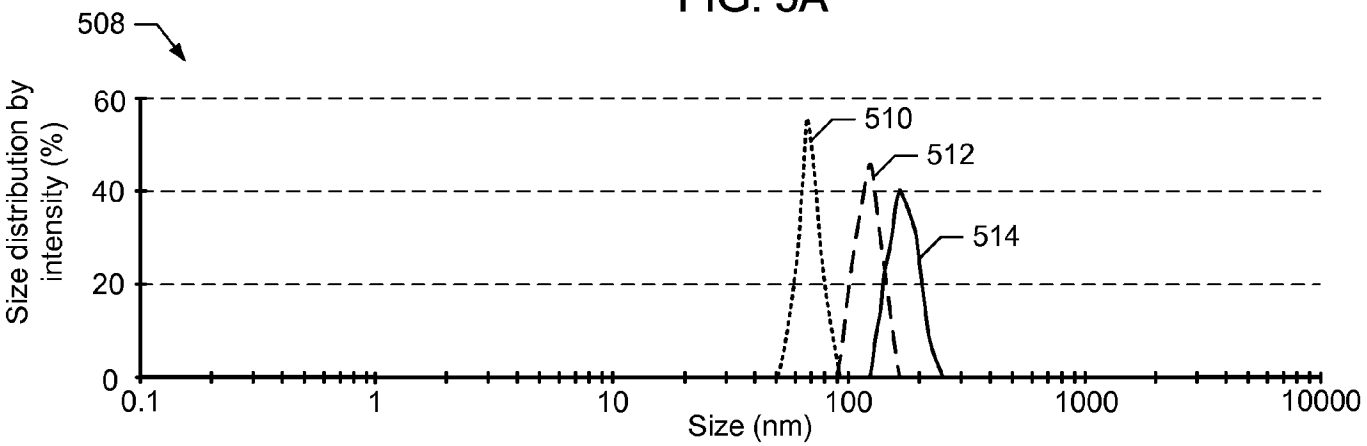
FIG. 5B is a graph illustrating example particle size distribution test results for contaminants in the imaging oil after being filtered by the example electrophoretic imaging oil filter of FIG. 2.

FIG. 5A is a graph 500 illustrating example particle size distributions 502, 504, and 506 of example contaminants in example imaging oil prior to entering the example electrophoretic imaging oil filter 200 of FIG. 2. FIG. 5B is a graph 508 illustrating example particle size distributions 510, 512, and 514 of the same type of example contaminants in the same type of imaging oil after being filtered by the example electrophoretic imaging oil filter 200 of FIG. 2. The example particle size distributions 502-506 and 510-514 are measured by intensity (e.g., percentage of all contaminants in the imaging oil test). The particle size distributions 502, 504, and 506 were measured prior to the filter 200 and correspond to respective ones of the particle size distributions 510, 512, and 514 that were measured after the filter 200. The particle size distributions 502 and 510, 504 and 512, and 506 and 514 represent different tests of the example filter 200. To generate the graphs 500 and 508, the electrostatic field generated between adjacent electrodes 202-230 of FIG. 2 was about 2 Volts per micrometer (V/μm). However, other electrostatic field strengths may be used to increase and/or decrease the sizes of particles that are filtered. For example, the electrostatic field strength between adjacent electrodes may be as low as 1 V/μm.

In general, the graphs 500 and 508 demonstrate that the example filter 200 effectively removes contaminants having particle sizes of about 250-300 nanometers (nm) and above. For example, the filter 200 shifted the particle size distribution from mostly about 600-1900 nm (distribution 502) to mostly about 55-90 nm (distribution 510). In another example, the filter 200 shifted the particle size distribution from mostly about 500-2500 nm and 5000-7000 nm (distribution 504) to mostly about 90-180 nm (distribution 512). In yet another example, the filter 200 shifted the particle size distribution from mostly about 400-2000 and 4000-7000 nm (distribution 506) to mostly about 130-250 nm (distribution 514).

Figure 6:
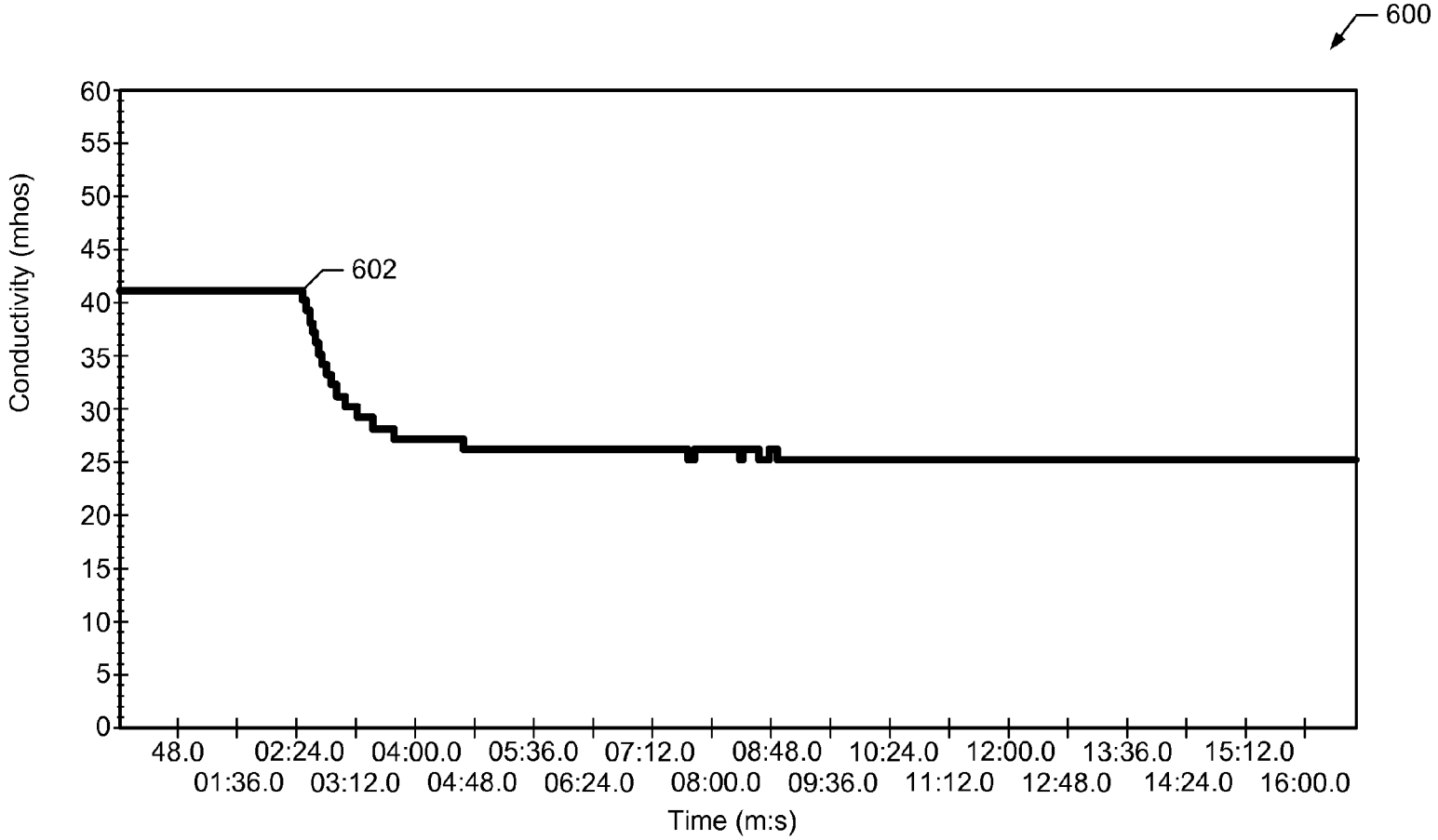
FIG. 6 is a graph illustrating example test results for conductivity of imaging oil as the imaging oil is filtered by the example electrophoretic imaging oil filter of FIG. 2.

FIG. 6 is a graph 600 illustrating an example change in the conductivity 602 of imaging oil as the imaging oil is filtered by the example electrophoretic imaging oil filter 200 of FIG. 2. The conductivity of the imaging oil corresponds to the total dissolved solids in the oil. Thus, as the filter 200 removes contaminants from the imaging oil, the conductivity 602 of the imaging oil is substantially reduced as illustrated in FIG. 6. FIG. 6 illustrates that the example filter 200 rapidly removes contaminants from the imaging oil partly due to increased flow rate and filter effectiveness as shown in FIGS. 5A and 5B.

Figure 7:
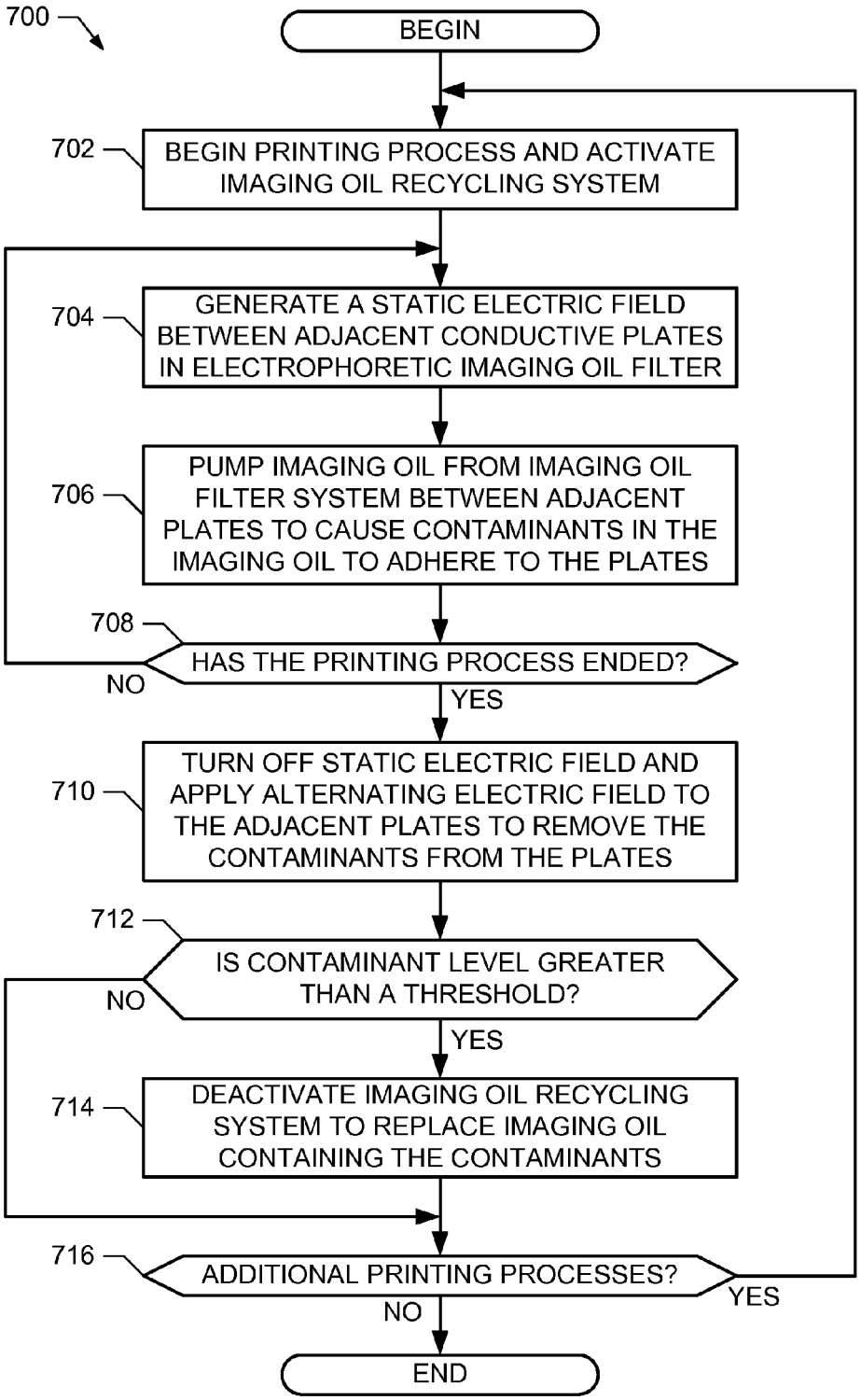
FIG. 7 is a flowchart illustrating an example process to filter imaging oil in accordance with the teachings herein.

FIG. 7 is a flowchart illustrating an example process 700 to filter imaging oil. The example process 700 may be used to implement the example electrophoretic imaging oil filters 102 and 200 and/or the example switching circuit 123 of FIGS. 1, 1A, and 2 to filter imaging oil in an imaging oil recycling system.

The example process 700 begins at block 702 by beginning a print process (e.g., using a photo imaging plate to print images on a print substrate) and activating an imaging oil recycling system (e.g., the imaging oil recycling system 100 of FIG. 1). The example electrophoretic imaging oil filter 102 (e.g., via the switching circuit 123 of FIG. 1) generates an electrostatic field between adjacent electrodes (e.g., the electrodes 118 and 120 of FIG. 1 and/or the electrodes 202-230 of FIG. 2) (block 704). The example imaging oil recycling system 100 then pumps (e.g., via pump 116) imaging oil from the imaging oil recycling system 100 (e.g., imaging oil in the second holding tank 114) between the adjacent electrodes 118 and 120 to filter the oil by causing contaminants in the imaging oil to adhere to one or both of the electrodes 118 and 120 (block 706).

The imaging oil recycling system 100 (e.g., via the example mode selector 138) determines whether the printing process has ended (block 708). If the printing process has not ended (block 708), control returns to block 704 to continue to generate the electrostatic(s) field and filter the imaging oil. On the other hand, when the printing process has ended (block 708), the switching circuit (e.g., via the mode selector 138) turns off the electrostatic field and applies an alternating electric field (e.g., via the AC source 126) to the adjacent electrodes (e.g., the electrodes 118 and 120 of FIG. 1 and/or the electrodes 202-230 of FIG. 2 (block 710). For example, the mode selector 138 may open the switches 128 and 134 to decouple the electrodes 118 and 120 from the DC sources 124 and 136, and close the switches 130 and 132 to couple the electrodes 118 and 120 to the AC source 126. The alternating electric field removes at least a portion of the contaminants from the electrodes 118 and 120 by electrophoretic force and causes the removed contaminants to be suspended in the imaging oil. In some examples, the pump 116 may also be deactivated when the printing process is ended to reduce the dispersion of the contaminants through the imaging oil recycling system 100.

The example mode selector 138 further determines (e.g., via the sensor 140 of FIG. 1) whether a contaminant level is greater than a threshold (block 712). If the contaminant level is greater than the threshold (block 712), the mode selector 138 may deactivate the imaging oil recycling system 100 to enable replacement and or cleaning of the imaging oil (e.g., by a technician and/or an external device) and provide a signal (e.g., a lit light emitting diode (LED), an audible alarm, etc.) indicating that servicing is required (block 714). In some other examples, the mode selector 138 may enable an automatic method to clean and/or replace the imaging oil with or without deactivating the imaging oil recycling system 100.

After replacing and/or cleaning the imaging oil (block 714), or if the contaminant level is less than a threshold (block 712), the mode selector 138 determines whether additional printing processes are to be performed (block 716). If there are additional printing processes (block 716), control returns to block 702 to begin the next printing process and/or activate the imaging oil recycling system 100. On the other hand, if there are no additional printing processes (block 716), the example process 700 may end.

From the foregoing, it will appreciate that the above disclosed printers, methods, and apparatus may be advantageously used to remove contaminants and/or other particles from liquids, such as cleaning fluids for printers. Example applications of the disclosed printers, methods, and apparatus include improving the operating life of a photo imaging plate in a liquid electrophotographic printer and improving print quality by eliminating, reducing the onset of, and/or slowing the progression of dot shrinkage. By improving the operating life of the photo imaging plate, printers using the example printers, methods, and/or apparatus described herein may operate at lower cost and with lower maintenance.

Although certain example methods and apparatus have been described herein, the scope of coverage of this patent is not limited thereto. On the contrary, this patent covers all methods, apparatus and articles of manufacture fairly falling within the scope of the claims of this patent.

What is claimed is:

1. An apparatus to filter imaging oil, the apparatus comprising:

a first set of electrodes;

a second set of electrodes, the first and second sets of electrodes being interleaved;

imaging oil; and a switching circuit to:

selectively generate an electrostatic field between adjacent ones of the first and second sets of electrodes to cause particles suspended in the imaging oil between adjacent ones of the first and second sets of electrodes to adhere to at least one of each adjacent pair of the first and second sets of electrodes; and selectively couple the first and second sets of electrodes to an alternating current source to generate alternating electric fields between the adjacent ones of the first and second sets of electrodes to cause the particles to be detached from the adjacent ones of the first and second sets of electrodes.

2. An apparatus as defined in claim 1, wherein each of the electrodes in the first set has a first tab, each of the electrodes in the second set has a second tab, the first and second electrodes are stacked such that the first tabs are juxtaposed and separated, and the second tabs are juxtaposed and separated.

3. An apparatus as defined in claim 1, wherein the electrostatic field generates an electrophoretic force to cause the particles to be urged toward the at least one of the adjacent ones of the first and second sets of electrodes.

4. An apparatus as defined in claim 1, wherein the electrostatic field is at least 1 volt per micrometer between the adjacent ones of the first and second sets of electrodes.

5. An apparatus as defined in claim 1, wherein the adjacent ones of the first and second sets of electrodes include at least three adjacent electrodes in parallel, wherein two of the at least three electrodes are in the first set of electrodes, are electrically coupled, and are on opposite sides of a third one of the at least three electrodes, and the two of the at least three electrodes are to generate electric fields with the third one of the at least three electrodes, the electric fields having different directions.

6. An apparatus as defined in claim 1, wherein the switching circuit further comprises a mode selector to selectively cause the adjacent ones of the first and second sets of electrodes to be coupled to different electric potentials.

7. An apparatus as defined in claim 6, wherein the mode selector is to determine whether a cleaning station is active and to cause the adjacent ones of the first and second sets of electrodes to be coupled to different electric potentials when the cleaning station is active.

8. An apparatus as to filter imaging oil, the apparatus comprising:

a first set of electrodes;

a second set of electrodes, the first and second sets of electrodes being interleaved; and a switching circuit to:

selectively generate an electrostatic field between adjacent ones of the first and second sets of electrodes to cause particles suspended in the imaging oil between adjacent ones of the first and second sets of electrodes to adhere to at least one of each adjacent pair of the first and second sets of electrodes; and selectively couple the first and second sets of electrodes to an alternating current source to generate alternating electric fields between the adjacent ones of the first and second sets of electrodes to cause the particles to be detached from the adjacent ones of the first and second sets of electrodes, wherein the adjacent ones of the first and second sets of electrodes are configured to receive the imaging oil from an imaging oil recycling system and to output filtered imaging oil to a cleaning station associated with a photo imaging plate.

9. An apparatus as defined in claim 8, wherein the switching circuit is to generate the electrostatic field when the cleaning station is active.

10. An apparatus as defined in claim 8, wherein the switching circuit is to couple the first and second sets of electrodes to the alternating current source when the cleaning station is inactive.

11. An apparatus as defined in claim 8, further comprising a housing containing the adjacent ones of the first and second sets of electrodes, the housing including an output port to be fluidly coupled to the cleaning station to output the filtered imaging oil to the cleaning station.

12. A method to filter imaging oil, comprising:

applying a first electric potential to a first set of electrodes;

applying a second electric potential to a second set of electrodes, the first and second sets of the electrodes being interleaved, the first electric potential and the second electric potential to generate electrostatic fields between adjacent ones of the first and second sets of electrodes;

causing imaging oil including suspended particles to be moved between the adjacent ones of the first and second sets of electrodes to cause at least a portion of the suspended particles to attach to at least one of the electrodes in each pair of adjacent electrodes; and applying an alternating current to the first and second sets of electrodes to generate alternating electric fields between adjacent ones of the first and second sets of electrodes to cause the particles attached to the at least one of the electrodes in each pair of adjacent electrodes to detach from the at least one of the electrodes.

13. A method as defined in claim 12, further comprising activating a cleaning station for a photo imaging plate and causing the imaging oil to be moved to the cleaning station from between the adjacent ones of the first and second sets of electrodes.

14. A method as defined in claim 13, wherein applying the first electric potential is in response to activating the cleaning station.

15. A method as defined in claim 13, further comprising deactivating the cleaning station, wherein applying the alternating current to the adjacent ones of the first and second sets of electrodes is in response to deactivating the cleaning station.

16. A method as defined in claim 12, further comprising replacing the imaging oil when a concentration of the particles exceeds a threshold.

17. A printer having a photo imaging plate, comprising:

a cleaning station to remove ink particles from the photo imaging plate using imaging oil; and a filter to receive the imaging oil including suspended ink particles and to remove at least a portion of the suspended ink particles from the imaging oil, the filter comprising:

a first set of electrodes;

a second set of electrodes, the first and second sets of electrodes being interleaved; and a switching circuit to:

selectively generate an electrostatic field between adjacent ones of the first and second sets of electrodes to cause particles suspended in the imaging oil between the adjacent ones of the first and second sets of electrodes to adhere to at least one of each adjacent pair of the first and second sets of electrodes; and selectively couple the first and second sets of electrodes to an alternating current source to generate alternating electric fields between the adjacent ones of the first and second sets of electrodes to cause the particles to be detached from the adjacent ones of the first and second sets of electrodes.

18. A printer as defined in claim 17, wherein a first electrode in the first set of electrodes is in circuit with a first terminal of the switching circuit, a second electrode in the second set of electrodes is in parallel and adjacent to the first electrode on a first side of the first electrode, the second electrode to be coupled to a second terminal of the switching circuit, and a third electrode in the first set of electrodes is in parallel and adjacent to the first electrode on a second side of the first electrode opposite the first side, the third electrode is in circuit with the second terminal of the switching circuit.

19. A printer as defined in claim 17, wherein the switching circuit is to generate the electrostatic field when the cleaning station is active and is to generate the alternating electric field when the cleaning station is inactive.

20. A printer as defined in claim 17, wherein the first set of electrodes and the second set of electrodes comprise flat conductive plates in a stacked arrangement.

* * * * *